United States Patent [19]

Mowbray

[11] 4,118,155

[45] Oct. 3, 1978

[54] FUEL PUMPING APPARATUS

[75] Inventor: Dorian Farrar Mowbray, Burnham, England

[73] Assignee: Lucas Industries Limited, Birmingham, England

[21] Appl. No.: 787,351

[22] Filed: Apr. 14, 1977

[30] Foreign Application Priority Data

Apr. 20, 1976 [GB] United Kingdom ..... 15897/76

[51] Int. Cl.[2] ..... F04B 19/02

[52] U.S. Cl. ..... 417/462; 417/221; 123/139 AL; 92/58

[58] Field of Search ..... 417/462, 220, 221, 218; 123/32 G, 139 AL; 92/58, 72

[56] References Cited

U.S. PATENT DOCUMENTS

| | | | |
|---|---|---|---|
| 1,895,353 | 1/1933 | Sturm | 417/462 |
| 2,621,606 | 12/1952 | Carlson | 417/462 |
| 3,771,506 | 11/1973 | Davis | 417/218 |
| 3,861,835 | 1/1975 | Batki | 417/462 |
| 3,883,270 | 5/1975 | Baxter | 417/462 |

*Primary Examiner*—C. J. Husar

[57] ABSTRACT

A fuel injection pumping apparatus includes a rotary distributor in which is formed a pair of transversely extending bores having their axes intersecting at the axis of rotation of the distributor member and lying in the radial plane passing through the point of intersection. Each bore accommodates a pair of plungers and the plungers of one of said pair define recesses which receive the inner ends of the plungers of the other pair. In this manner the plungers can be moved inwardly a greater extent before collision of the plungers takes place.

4 Claims, 3 Drawing Figures

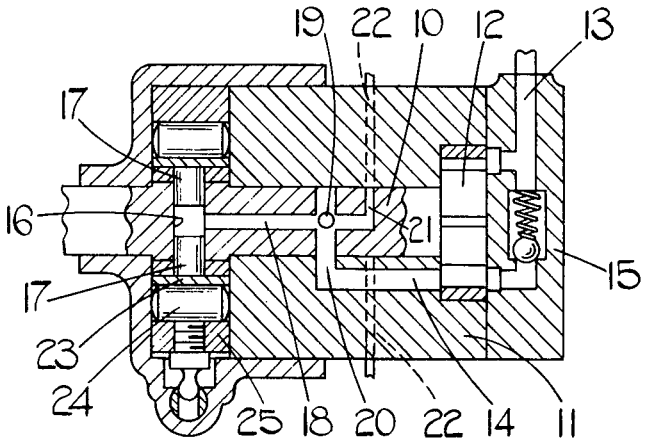
PRIOR ART FIG. 1.
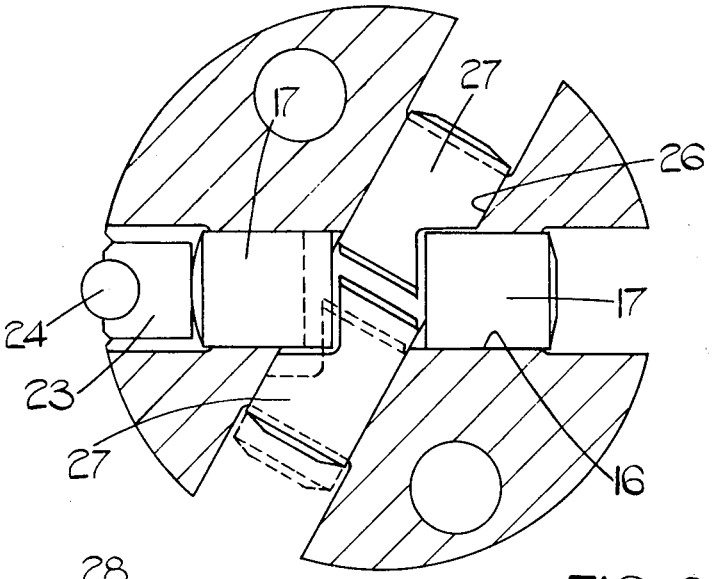
FIG. 2.
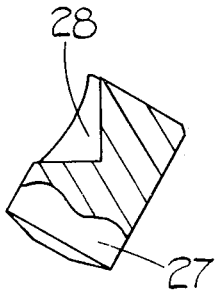
FIG. 3.

FUEL PUMPING APPARATUS

This invention relates to liquid fuel pumping apparatus for supplying fuel to internal combustion engines and of the kind comprising a rotary distributor member located within a housing, a diametrically disposed bore formed in the distributor member, a pair of plungers slidable within the bore, inlet and outlet passages in the distributor member through which liquid fuel is conveyed to and from a space defined between the plungers, an annular cam ring surrounding the distributor member and cam lobes formed on the internal periphery of the cam ring for imparting simultaneous inward movement to the plungers as the distributor member is rotated.

It is known in an apparatus of the kind specified in order to increase the volume of fuel pumped to provide a second diametrically disposed bore in the distributor member with the axes of said bores intersecting at the axis of rotation of the distributor member and to provide a second pair of plungers in the second bores. The extent of inward movement of the plungers is however limited because of the need to avoid abutment of the plungers at the inward limit of their stroke. The limit of outward movement of the plungers is determined by the need to maintain a certain length of plunger within the bore to provide an adequate bearing surface and also to minimise leakage. Assuming a given size of distributor member and housing and also a given diameter of plunger, the object of the invention is to increase the amount of fuel which can be pumped by the plungers during their inward movement.

According to the invention in an apparatus of the kind specified a second diametrically disposed bore is provided having its longitudinal axis intersecting the longitudinal axis of the first mentioned bore at the axis of rotation of the distributor member, a further pair of plungers in said further bore, one of said pairs of plungers defining recesses into which the plungers of the other pair can move as the plungers are moved inwardly by the cam lobes whereby the plungers can be moved inwardly an additional amount without collision.

According to a further feature of the invention surfaces of said recess are are shaped so as to prevent rotation of said one pair of plungers.

According to another aspect of the invention the longitudinal axes of said bores are inclined relative to each other in the radial plane including the point of intersection of said axes, each plunger of said one pair of plungers defining a recess at its inner end of one of the other pair of plungers, the walls of said recesses being shaped so that rotation of said one pair of plungers is prevented.

According to a further feature of the invention said recesses in said one pair of plungers are of part cylindrical form with their axes inclined to the axes of the plungers in which they are formed at an angle substantially equal to the minor angle between said bores.

One example of a fuel pumping apparatus in accordance with the invention will now be described with reference to the accompanying drawings in which:

FIG. 1 is a sectional side elevation of a typical pump to which the invention may be applied, FIG. 2 is a sectional view in the plane of the axes of the bores containing the pumping plungers and FIG. 3 shows a section through one of the plungers.

With reference to the drawings the apparatus comprises a rotary distributor member 10 which is mounted within a housing 11. The distributor member 10 at one end is connected to a drive shaft whereby it can be driven in synchronism with the engine with which the apparatus is associated. The other end of the distributor member is connected to the rotary part of a feed pump 12 having an inlet 13 which in use is connected to a source of liquid fuel. The outlet of the feed pump communicates with a passage 14 formed within the housing and the output pressure of the fuel feed pump is controlled by a valve 15 conveniently constructed so that the output pressure of the feed pump increases as the speed of operation of the associated engine increases.

Formed within the distributor member is a transversely extending bore 16 in which is mounted a pair of pumping plungers 17. The bore 16 communicates with a longitudinal passage 18 formed in the distributor member and at one point this communicates with a plurality of inlet passages 19 which extend outwardly to the periphery of the distributor member. The inlet passages 19 register in turn with an inlet port 20 which is connected directly to the passage 14.

The passage 18 also communicates with a delivery passage 21 extending radially to the periphery of the distributor member and adapted to register in turn and as the distributor member rotates, with a plurality of outlet passages 22. In use the outlet passages are connected to the injection nozzles of the associated engine.

At their outer ends the plungers are engaged by shoes 23 which carry rollers 24 respectively. Surrounding the distributor member at this point is a cam ring 25 on the internal periphery of which are formed a plurality of pairs of inwardly directed cam lobes not shown.

In operation, the apparatus is shown in the position in which fuel is flowing to the bore 16 from the outlet of the feed pump, such fuel flowing by way of the port 20 and one of the inlet passages 19. As the distributor member rotates the inlet passage 19 moves out of register with the inlet port 20 and the delivery passage 21 moves into register with one of the outlet passages 22. When such communication has occurred the plungers are moved inwardly by the cam lobes to discharge fuel to an injection nozzle of the associated engine. As the distributor member continues to rotate the process is repeated and the injection nozzles of the engine are supplied with fuel in turn.

The quantity of fuel which is supplied at each delivery stroke is controlled in a manner not shown. Such control may be effected by limiting the outward movement of the plungers by some form of mechanical arrangement whereby the extent of outward movement can be determined or the control may be effected by limiting the amount of fuel which can flow into the bore 16 during the filling thereof.

Turning now to FIG. 2 it is known with such apparatus to increase the amount of fuel which can be supplied by the apparatus at each delivery stroke, by providing an additional pair of plungers which are positioned in such manner that all plungers are moved inwardly at the same time. As shown in FIG. 2 an additional transversely extending bore 26 is provided which accommodates a pair of plungers 27. The longitudinal axes of the bores 16 and 26 intersect at the axis of rotation of the distributor member. In the case of a pump for supplying fuel to a four cylinder engine two pairs of diametrically disposed cam lobes are provided and these are positioned at right angles. In this case therefore the bores 16 and 26 must also be positioned at right angles. In the case of a pump for supplying fuel to a six cylinder engine then three pairs of cam lobes are provided with the spacing between adjacent cam lobes being 60°. In this case therefore the bores 16 and 26 must be angularly displaced, the minor angle of displacement being 60°. The examples shown in FIG. 2 is for supplying fuel to a six cylinder engine.

The extent of inward movement of unmodified plungers is of course limited by the possibility of collision of the plungers and as explained it is not possible to increase the outward movement of the plungers without running into problems of leakage and insufficient bearing area between the plungers and the walls of the bores in which they are located. Moreover, it is desirable to alter as few components of the apparatus as possible in order to make the apparatus suitable for supplying fuel to other engines. In order to provide for a possible increased delivery of fuel the plungers 27 at their inner ends are provided with recesses. In the case of a four cylinder engine recesses would be provided on both sides of the plungers 27 so that the plungers 17 could move inwardly without the risk of collision occurring. In the case where the apparatus is for supplying fuel to a six cylinder engine as shown in FIG. 2, the plungers 27 are each provided with a single recess 28 at their inner ends. Conveniently the recesses 28 are formed by using an end mill so that the recess is of part-cylindrical form. The axis of the recess is inclined relative to the axis of the plunger in which the recess is formed by an angle which is equal to the minor angle between the bores 16 and 26.

FIG. 2 of the drawing shows the plungers moved inwardly their maximum extent and it will readily be apparent that it has been possible to provide more inward movement than would have been the case if the recesses were not provided. As it happens the plungers 27 are slightly longer than the plungers 17. It will be noted that the walls of the recesses which are presented to the end walls of the plungers 17 are maintained in close proximity to the end walls of the plungers 17 even during the time when the plungers are moved outwardly. This is demonstrated by the dash lines in FIG. 2. This minimizes the extent of angular movement of the plungers 27 in their bores because if angular movement does take place, the presented walls of the plungers will engage with each other to limit the extent of angular movement. If desired, other means may be provided to prevent angular movement of the plungers 27. In the case of a pump for supplying fuel to a four cylinder engine, then the end walls of the plungers 17 and the equivalent walls of the recesses do move away from each other as the plungers move outwardly. Nevertheless, as long as the plungers 17 project into the bore 26 the tongs at the ends of the plungers 27 which are formed by the recesses, will in the event of angular movement of the plungers 27 engage the plungers 17 to limit the extent of angular movement of the plungers 27. When the plungers move inwardly, if angular movement of one or both plungers 27 has occurred then the plungers 17 will engage the aforesaid tongs and move the plungers 27 angularly to their correct position.

I claim:

1. A liquid fuel pumping apparatus for supplying fuel to an internal combustion engine and of the kind comprising a rotary distributor member located within a housing, a diametrically disposed bore formed in the distributor member, a pair of plungers slidable within the bore, inlet and outlet passages in the distributor member through which liquid fuel is conveyed to and from a space defined between the plungers, an annular cam ring surrounding the distributor member, cam lobes formed on the internal periphery of the cam ring, for imparting simultaneous inward movement to the plungers as the distributor member is rotated, a second diametrically disposed bore in the distributor member, said second bore having its longitudinal axis intersecting the longitudinal axis of the first mentioned bore at the axis of rotation of the distributor member, a further pair of plungers in said further bore, one of said pairs of plungers defining recesses into which the plungers of the other pair can move as the plungers are mored inwardly by the cam lobes whereby the plungers can be moved inwardly an additional amount without collision.

2. An apparatus according to claim 1 in which surfaces of said recesses are shaped so as to prevent rotation of said one pair of plungers.

3. An apparatus according to claim 1 in which the longitudinal axes of said bores are inclined relative to each other in the radial plane including the point of intersection of said axes, each plunger of said one pair of plungers defining a recess at its inner end and in which is located the inner end of one of the other pair of plungers, the walls of said recesses being shaped so that rotation of said one pair of plungers is prevented.

4. An apparatus according to claim 3 in which the recesses in said one pair of plungers are of part cylindrical form with their axes inclined to the axes of the plungers in which they are formed at an angle substantially equal to the minor angle between said bores.

* * * * *